US009329535B2

(12) United States Patent
Nakamoto et al.

(10) Patent No.: US 9,329,535 B2
(45) Date of Patent: May 3, 2016

(54) IMAGE HEATING APPARATUS

(71) Applicant: CANON KABUSHIKI KAISHA, Tokyo (JP)

(72) Inventors: Ikuo Nakamoto, Matsudo (JP); Shigeru Hirano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/450,115

(22) Filed: Aug. 1, 2014

(65) Prior Publication Data

US 2015/0043953 A1 Feb. 12, 2015

(30) Foreign Application Priority Data

Aug. 9, 2013 (JP) ..... 2013-166255

(51) Int. Cl.
*G03G 15/00* (2006.01)
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/20; G03G 15/2021; G03G 15/2025; G03G 2215/2025
USPC ..... 399/122, 328–331
See application file for complete search history.

(56) References Cited

U.S. PATENT DOCUMENTS 6,459,877 B1 * 10/2002 Yoda et al. ..... 399/325
2008/0166653 A1 * 7/2008 Matsubara et al. ..... 430/124.32
2009/0003871 A1 * 1/2009 Matsumoto ..... G03G 15/168 399/101
2010/0040386 A1 * 2/2010 Mizutani et al. ..... 399/44
2010/0183347 A1 * 7/2010 Creteau et al. ..... 399/329

FOREIGN PATENT DOCUMENTS

JP 8-305187 A 11/1996

* cited by examiner

*Primary Examiner* — Walter L Lindsay, Jr.
*Assistant Examiner* — Jessica L Eley
(74) *Attorney, Agent, or Firm* — Canon U.S.A., Inc, IP Division

(57) ABSTRACT

A fixing apparatus includes a fixing belt, a pressure roller, a heater, a stay holder, and a scraper. The fixing belt is configured to heat an image on a sheet at a nip portion and has an inner surface with a grease applied thereon. The pressure roller drives and rotates the fixing belt and forms the nip portion between the pressure roller and the fixing belt. The heater and the stay holder press the fixing belt toward the pressure roller from the inner surface of the fixing belt. The scraper scrapes the lubricant transferred to the pressure roller in an area that can come into contact with the fixing belt and that does not come into contact with a maximum width sheet introducible into the fixing apparatus on one end side in a rotational axis direction of the pressure roller.

13 Claims, 8 Drawing Sheets

IMAGE HEATING APPARATUS

BACKGROUND OF THE INVENTION

1. Field of the Invention

The present invention relates to an image heating apparatus for heating a toner image on a sheet. The image heating apparatus can be used in, for example, an image forming apparatus of the electrophotographic type or electrostatic recording type, such as a printer, a copier, a facsimile machine, and a multifunction machine having a plurality of functions of them.

2. Description of the Related Art

Nowadays, image forming apparatuses need quick response (time from transmission of a print instruction to outputting of an image; hereinafter referred to as wait time). A reduction in the wait time is greatly affected by the warm-up time of a fixing apparatus (image heating apparatus).

A fixing apparatus that uses a thin endless belt having a low heat capacity (hereinafter referred to as belt) is described in Japanese Patent Laid-Open No. 8-305187. Specifically, the fixing apparatus employs the technique of pressing the belt using a ceramic heater from its inside toward a pressure roller and driving and rotating the belt using the pressure roller. The use of that technique aims to reduce the wait time.

In the fixing apparatus employing that technique, because the belt slides on the ceramic heater, a heat-resistant lubricant, such as grease or oil, is applied on the inner surface of the belt. The heat-resistant lubricant reduces the frictional resistance between the inner surface of the belt and the ceramic heater, thus facilitating the rotation of the belt driven by the pressure roller.

The fixing apparatus described in Japanese Patent Laid-Open No. 8-305187 includes blades for removing the lubricant. The blades are disposed on the outer surface of the belt on both ends in the width direction. The blades are included to prevent the lubricant leaking out from the ends of the belt with prolonged use of the fixing apparatus from moving to the outer surface of the belt and adhering to a sheet.

However, because the blades for removing the lubricant in the fixing apparatus described in Japanese Patent Laid-Open No. 8-305187 are in contact with the belt, stability of rotation of the belt may be degraded. The conceivable reason for this is that friction caused by the state where the blades are in contact with the belt acts as a force inhibiting the driven rotation of the belt. If the stability of rotation (running) of the belt is inhibited, supplying heat to a sheet becomes instable, and this may lead to an image defect, such as a fixing failure or gloss unevenness.

SUMMARY OF THE INVENTION

The present invention provides an image heating apparatus capable of discouraging adhesion of a lubricant to a sheet.

Further features of the present invention will become apparent from the following description of exemplary embodiments with reference to the attached drawings.

DESCRIPTION OF THE EMBODIMENTS

Embodiments of the present invention are described in detail below with reference to the drawings. In the following embodiments, an image heating apparatus according to the present invention is described as a fixing apparatus for fixing an unfixed toner image on a printing medium (sheet). The image heating apparatus can also be implemented as a heating processor for heating and pressing a printing medium that bears a fixed image or a semi-fixed image to adjust the state of the surface of the image.

First Embodiment

Figure 1:
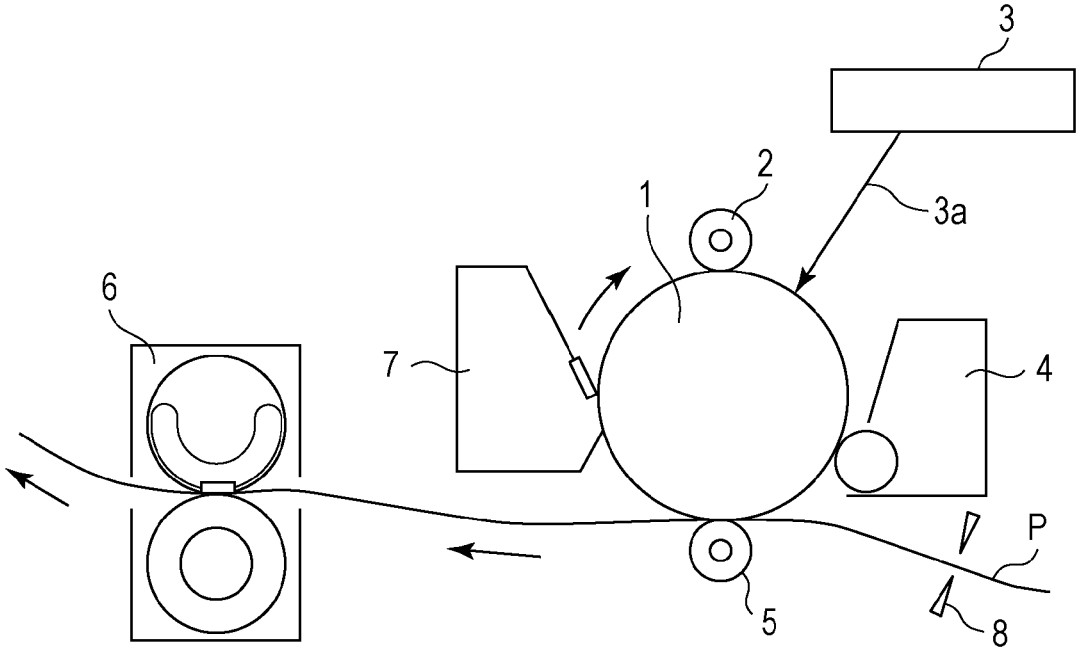
FIG. 1 is an explanatory view of a configuration of an image forming apparatus according to a first embodiment.

First, an image forming apparatus is described with reference to FIG. 1. FIG. 1 is an explanatory view for describing a configuration of the image forming apparatus that incorporates a fixing apparatus functioning as an image heating apparatus. The image forming apparatus illustrated in FIG. 1 is a laser-beam printer that employs a transfer-type electrophotographic process.

[Image Forming Apparatus]

As illustrated in FIG. 1, the image forming apparatus includes a photosensitive drum 1, a charging roller 2, a laser scanner 3, a developing device 4, and a transfer roller 5. The charging roller 2, laser scanner 3, developing device 4, and transfer roller 5 are disposed around the photosensitive drum 1 along its rotational direction. A toner image T is formed through processes for forming a latent image, developing the image, and transferring the image.

The photosensitive drum 1 in the present embodiment is one example of an electrophotographic photosensitive member as an image-bearing member. The photosensitive drum 1 includes a cylindrical conductive substrate made of aluminum, nickel, or other material and a photosensitive layer on the substrate. The photosensitive layer can be made of a photosensitive material, such as organic photoconductor (OPC), amorphous selenium, or amorphous silicon.

The photosensitive drum 1 rotates at a predetermined circumferential speed in the clockwise direction indicted by the arrow in FIG. 1. First, the surface of the photosensitive drum 1 is charged uniformly to a predetermined polarity and potential by the charging roller 2 as a charger.

Then, the uniformly charged surface is subjected to a scanning exposure 3*a*, and an electrostatic latent image is formed thereon. The scanning exposure 3*a* is performed by the laser scanner 3 controlling an ON/OFF state of a laser beam in accordance with an image signal.

The electrostatic latent image is developed and visualized as the image T by the developing device 4 containing black toner. Examples of a developing method may include a jumping development method, a two-component developing method, and a FEED development method. The combination of image exposure and reverse development is typically used.

The visualized image T is conveyed to the transfer roller 5 by rotation of the photosensitive drum 1. The conveyed image T is transferred from the photosensitive drum 1 to a sheet P by the transfer roller 5 as a transfer device.

At this time, a sensor 8 detects the leading edge of the conveyed sheet P, and this is used in controlling timing for conveying the sheet P. The sheet P is conveyed such that its writing position and the image formation position of the image T on the photosensitive drum 1 match with each other in the position of the transfer roller 5.

The conveyed sheet P is nipped and conveyed between the photosensitive drum 1 and the transfer roller 5. The image T on the photosensitive drum 1 is sequentially transferred to the sheet P.

The sheet P with the transferred image T is separated from the photosensitive drum 1 and introduced into a fixing apparatus 6. The fixing apparatus 6 corresponding to the image heating apparatus fixes the toner image on the sheet by applying heat and pressure thereon.

The sheet P with the fixed toner image is discharged out of the image forming apparatus.

When the sheet P is separated from the photosensitive drum 1, toner that has not been transferred to the sheet P remains on the surface of the photosensitive drum 1. A cleaning device 7 cleans the photosensitive drum 1 by removing the remaining toner and enables images to be formed repeatedly.

[Fixing Apparatus]

Figure 2:
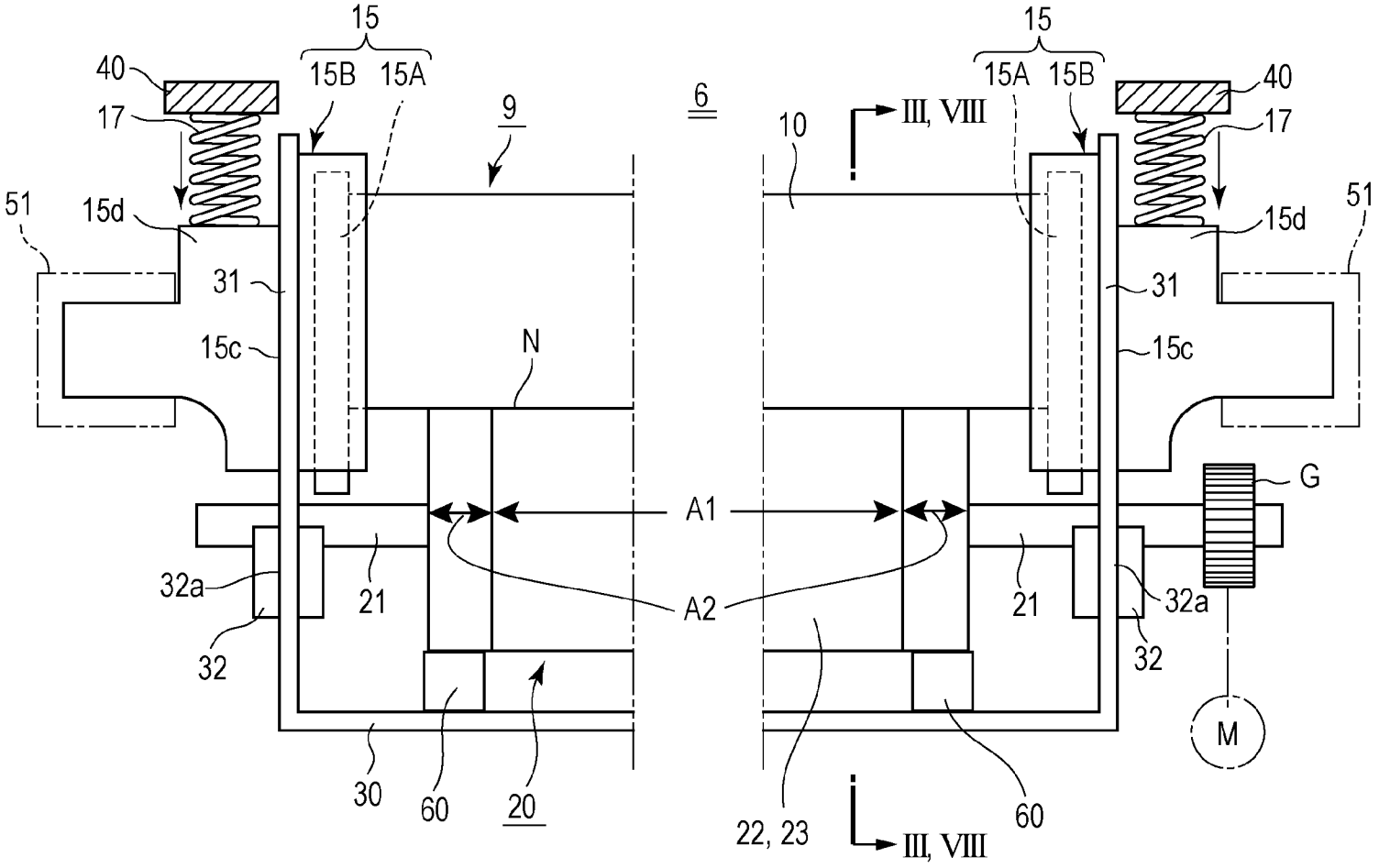
FIG. 2 is an explanatory view of a configuration of a fixing apparatus according to the first embodiment.
Figure 3:
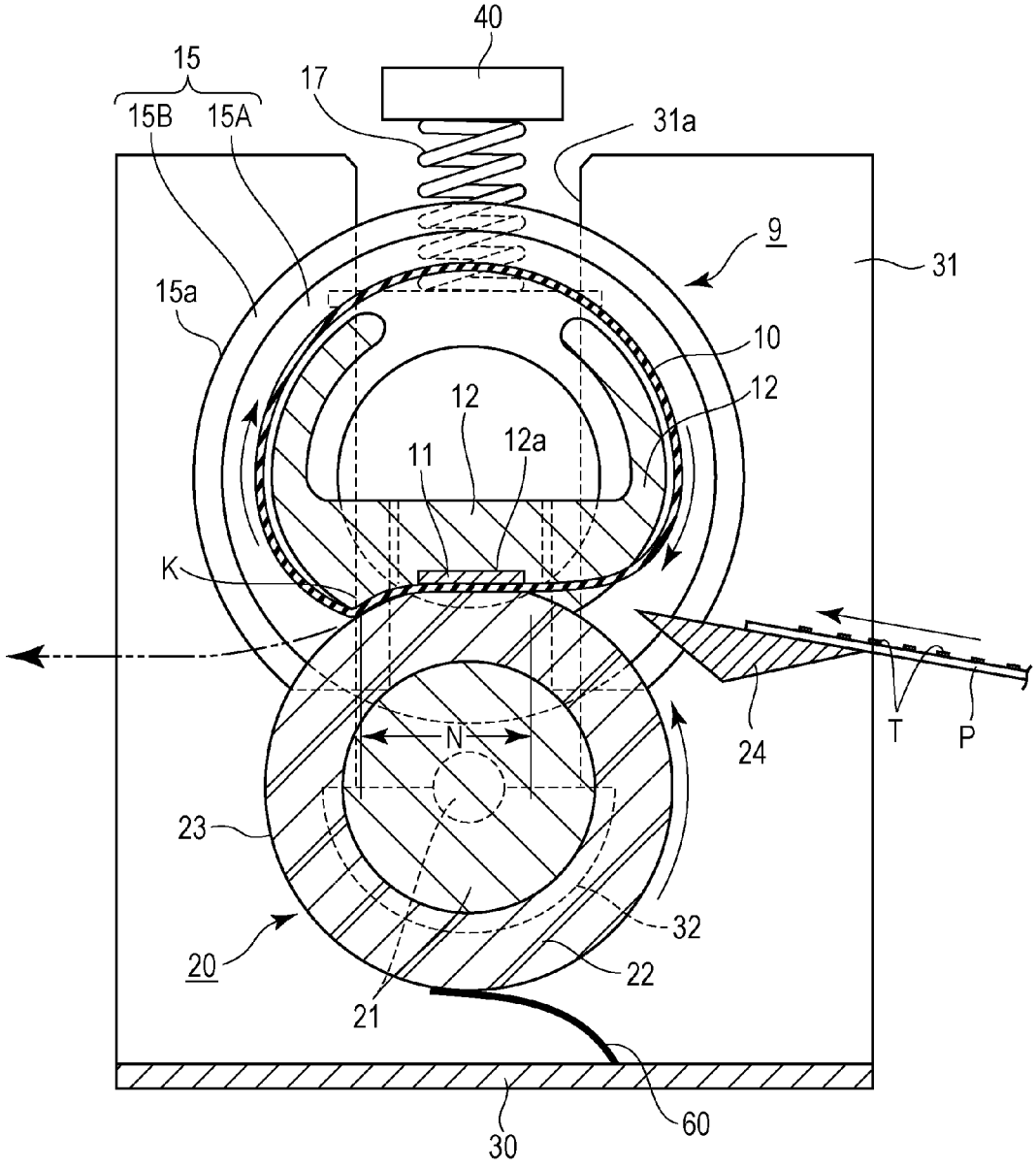
FIG. 3 is a cross-sectional explanatory view of the fixing apparatus taken along the line III-III in FIG. 2.
Figure 4:
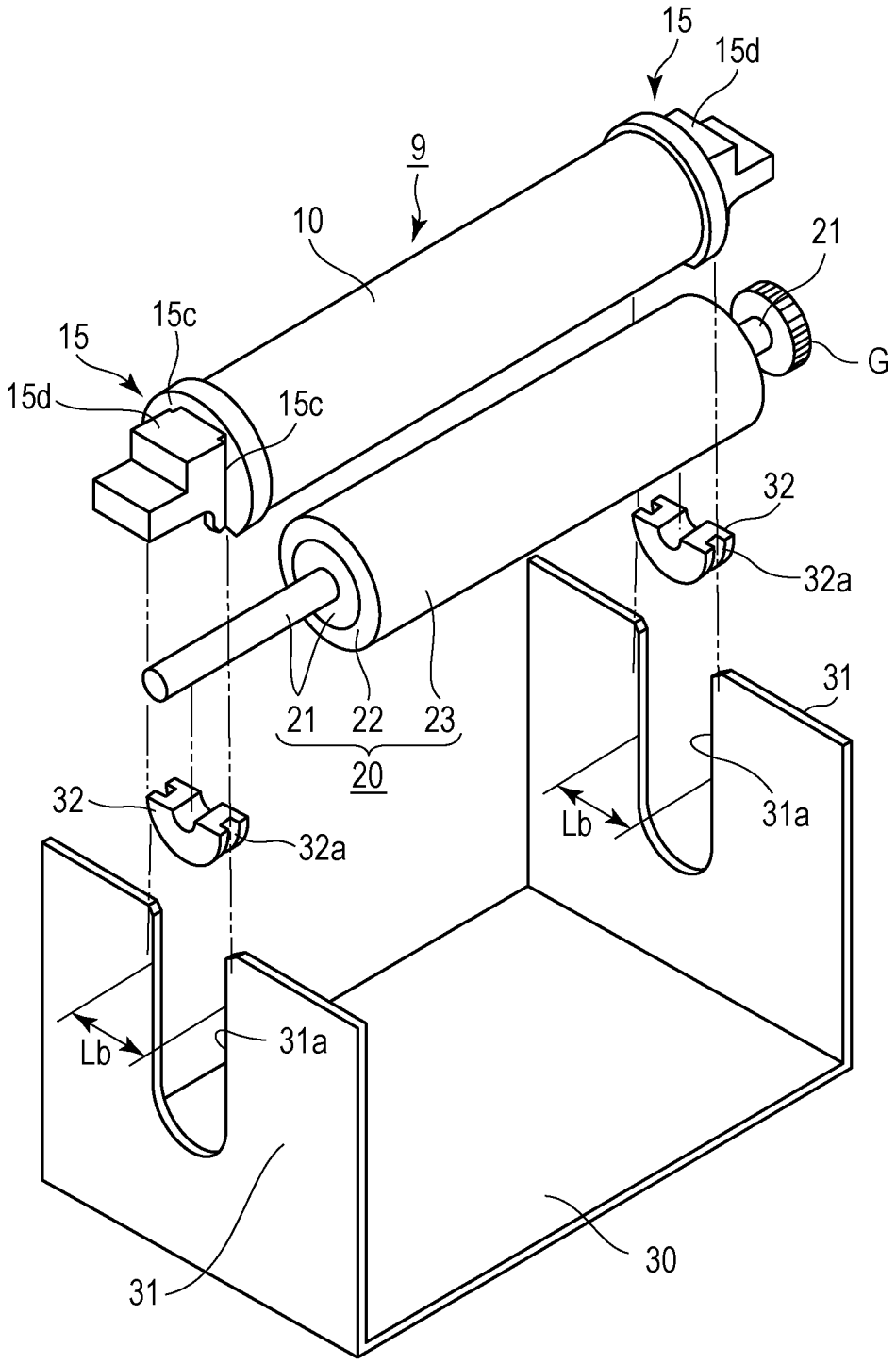
FIG. 4 is an exploded explanatory view of the fixing apparatus.

Next, a configuration of the fixing apparatus 6 is described in detail with reference to the drawings. FIG. 2 is an explanatory view of the configuration of the fixing apparatus according to the present embodiment. FIG. 3 is a cross-sectional explanatory view of the fixing apparatus 6 taken along the line III-III in FIG. 2. FIG. 4 is an exploded explanatory view of the fixing apparatus. In the following description, the width direction of the fixing apparatus 6 or members included therein is a direction substantially parallel with a direction perpendicular to a sheet conveying direction in a sheet conveying path plane and is a direction substantially parallel with a rotational axis direction of the pressure roller. In the description about the fixing apparatus 6, the frontal surface is a surface viewed from the side which a sheet enters, and the rear surface is a surface opposite the frontal surface (surface on the sheet outlet side). Left and right are left (near side) and right (far side), respectively, viewed from the frontal surface of the apparatus. The upstream and downstream sides are the ones in the sheet conveying direction.

As illustrated in FIG. 3, the fixing apparatus 6 according to the present embodiment is an apparatus of the belt (film) heating type and the pressing member driving type using a cylindrical metallic belt (endless belt that heats the image T on a sheet at a nip portion N) as a heating member. The fixing apparatus 6 serves the function of heating an unfixed image T borne on the sheet P passing through the nip portion N using a fixing belt 10.

As illustrated in FIG. 2, the fixing apparatus 6 includes a heating unit 9, a pressure roller 20, and an apparatus housing (sheet-metal frame) 30 including right and left side plates 31. The heating unit 9 and the pressure roller 20 are held substantially in parallel with each other by the right and left side plates 31. The heating unit 9 and the pressure roller 20 are in pressure contact with each other and thus constitute the nip portion N.

The heating unit 9 has the function of heating the image T on the sheet passing through the nip portion N. The heating unit 9 is urged toward the pressure roller 20 such that the heating unit 9 constitutes the nip portion N in cooperation with the pressure roller 20.

As illustrated in FIG. 3, the heating unit 9 is an assembly of a plurality of components described below.

A stay holder 12 having heat resistance and rigidity and extending in the width direction.

A heater 11 corresponding to a heating member, fit in a recess 12*a* (see FIG. 3) in the surface opposite to the fixing belt 10 of the stay holder 12, fixed and supported therein, and generating heat by energization.

The fixing belt 10 corresponding to an endless belt, fit on the outside of the stay holder 12 so as to cover the stay holder 12, and having the inner surface with grease applied thereon.

A flange portion 15 attached on each of both ends of the stay holder 12 in the width direction and functioning as a regulator configured to regulate lateral movement toward the width direction (direction of the generatrix) of the fixing belt 10.

Accordingly, the fixing apparatus 6 includes the components described below.

The fixing belt 10 corresponding to an endless belt and configured to heat the image T on the sheet P at the nip portion N.

The pressure roller 20 corresponding to a driving rotator and forming the nip portion N between the pressure roller 20 and the fixing belt 10.

The heater 11 and the stay holder 12 corresponding to a pressing member and configured to press the fixing belt 10 from its inner surface side toward the pressure roller 20.

The fixing apparatus 6 further includes scrapers 60 configured to a scraping member configured to remove a lubricant, in addition to the above components. The details of the scrapers 60 are described below.

As illustrated in FIG. 3, the pressure roller 20 corresponding to the driving rotator is rotated in the counterclockwise direction indicated by the arrow in the drawing. The pressure roller 20 constitutes the nip portion N in cooperation with the heating unit 9, and thus conveys the sheet P nipped by the nip portion N in a leftward direction indicated by the arrow in the drawing.

The pressure roller 20 includes a cylindrical core bar 21, an elastic layer 22 covering the core bar 21, and a release layer 23 for facilitating release of toner. The release layer 23 coats the elastic layer 22 with a heat-resistant resin material. As the release layer 23 in the present embodiment, tetrafluoroetylene perfluoroalkylvinylether copolymer (PFA) is used.

As illustrated in FIG. 4, each of the right and left side plates 31 in the apparatus housing 30 has an opening in its upper side. Each of the right and left side plates 31 has a fit slit 31*a* having a shape in which the opening extends toward the inside of the side plate 31. The width of the opening is Lb. The fit slits 31*a* in the right and left side plates 31 have the same shape (are symmetrical).

A bearing member 32 is arranged on the bottom of each of the fit slits 31*a*. The bearing member 32 includes a fitting section 32*a* and engages with the apparatus side plate 31. The right and left bearing members 32 hold the pressure roller 20 between the left and right side plates 31 by supporting the right and left ends of the core bar 21 so as to allow the pressure roller 20 to be freely rotatable.

Each of the right and left flange portions 15 includes a fitting section 15*c* fit in the fit slit 31*a*. Thus the heating unit 9 is arranged above the pressure roller 20 and between the left and right side plates 31.

Each of the right and left flange portions 15 includes a pressing section 15*d*. The pressing section 15*d* is pressed by a pressing spring 17 (described below). Thus the heating unit 9 is urged toward the pressure roller 20.

The shrinkable pressing spring 17 (elastic member) is arranged between the pressing section 15*d* and a spring receiving member 40 fixed on the apparatus housing 30. The pressing section 15*d* is pressed by the elastic force of the pressing spring 17. The heating unit 9 urged toward the pressure roller 20 presses the fixing belt 10 against the upper surface of the pressure roller 20 by a predetermined pressing force (elastic force). The fixing belt 10 and the pressure roller 20 constitute the nip portion N having a predetermined width by being pressed against their respective elasticity.

The heating unit 9 is urged toward the pressure roller 20 through the stay holder 12 and the heater 11. Accordingly, in the present embodiment, the heater 11 and the stay holder 12 function as a pressing member. As illustrated in FIG. 3, at the nip portion N, the fixing belt 10 is sandwiched between the lower surface of the stay holder 12 holding the heater 11 and the upper surface of the pressure roller 20. The fixing belt 10 is warped along the shape of the lower surface of the stay holder 12, and its inner surface is in close contact with the flat surface of the lower surface of the stay holder 12 and the lower surface of the heater 11.

A driving gear G is fixed on one end side of the core bar 21 in the pressure roller 20. The driving gear G receives a rotational force from a motor (driving portion) M, and thus the pressure roller 20 is rotated at a predetermined rotational speed in the counterclockwise direction indicated by the arrow in FIG. 3. With the rotation of the pressure roller 20, a friction occurs between the pressure roller 20 and the fixing belt 10 in the heating unit 9 at the nip portion N. This friction causes the fixing belt 10 to receive a force for rotating the fixing belt 10. Accordingly, the fixing belt 10 is in a state where it rotates in the clockwise direction indicated by the arrow in FIG. 3 around the stay holder 12 while sliding such that the inner surface of the fixing belt 10 is in close contact with the lower surface of the heater 11 (pressure roller driving type).

The fixing belt 10 frictionally slides on the heater 11 and the stay holder 12 disposed inside by its rotation driven by the pressure roller 20. To suppress abrasion of the fixing belt 10 caused by that frictional sliding and stabilize the driven rotation, the frictional resistance between the fixing belt 10 and each of the heater 11 and the stay holder 12 can be reduced. To this end, in the present embodiment, a lubricant, such as a heat-resistant grease, is applied on the surface of each of the heater 11 and the stay holder 12 and the inner peripheral surface of the fixing belt 10. This enables smooth rotation of the fixing belt 10.

The heater 11 as the heating member heats the nip portion N to melt and fix the image T on the sheet P through the fixing belt 10. The following specific description is based on a state where rotation of the pressure roller 20 causes rotation of the fixing belt 10, the heater 11 is energized, the temperature of the heater 11 rises to a predetermined temperature, and the temperature is adjusted.

First, the sheet P bearing an unfixed image T is conveyed between the fixing belt 10 and the pressure roller 20 at the nip portion N along a fixing inlet guide 24. Then, the sheet P is conveyed while being nipped at the nip portion N, and the unfixed image T is heated and fixed by heat from the heater 11 through the fixing belt 10. After that, the sheet P having passed through the nip portion N becomes separated from the outer surface of the fixing belt 10, is guided by a fixation discharging guide (not illustrated), and is discharged onto a discharge tray (not illustrated).

The fixing belt 10 as the endless belt is a flexible sleeve having a small thermal capacity. More specifically, the fixing belt 10 includes a base layer made of a high thermal conductive metal material having high heat resistance and has a total thickness of 500 μm or less to enable a fixing process to quickly start. As the metal material, a metal, such as aluminum, nickel, copper, or zinc, or an alloy selecting from these metals may be used. To have an increased life of the fixing apparatus, the fixing belt 10 may preferably have a total thickness of 30 μm or more as a metal sleeve having a sufficient strength and a good durability. Accordingly, the total thickness of the fixing belt 10 may preferably be in the range of 30 μm to 500 μm.

The surface layer of the fixing belt 10 is coated with PFA as a heat-resistant resin having good releasability to prevent offset and ensure separability of the sheet P. As the heat-resistant resin having good releasability, a mixture or a single component selected from fluoroplastics and silicone resins described below may be used. Examples thereof may include polytetrafluoroethylene (PTFE), fluorinated-ethylene-propylene copolymer (FEP), ethylene tetrafluoro ethylene copolymer (ETFE), polychlorotrifluoroethylene (CTFE), and polyvinylidene fluoride (PVDF).

The inner surface of the metal sleeve in contact with the heater 11 may be overlaid with a layer having enhanced lubricity, such as a fluoroplastic layer, a polyimide layer, or a polyamide imide layer. In the present embodiment, the application of grease on the inner surface of the belt 10 facilitates sliding with the heater 11.

Figure 5:
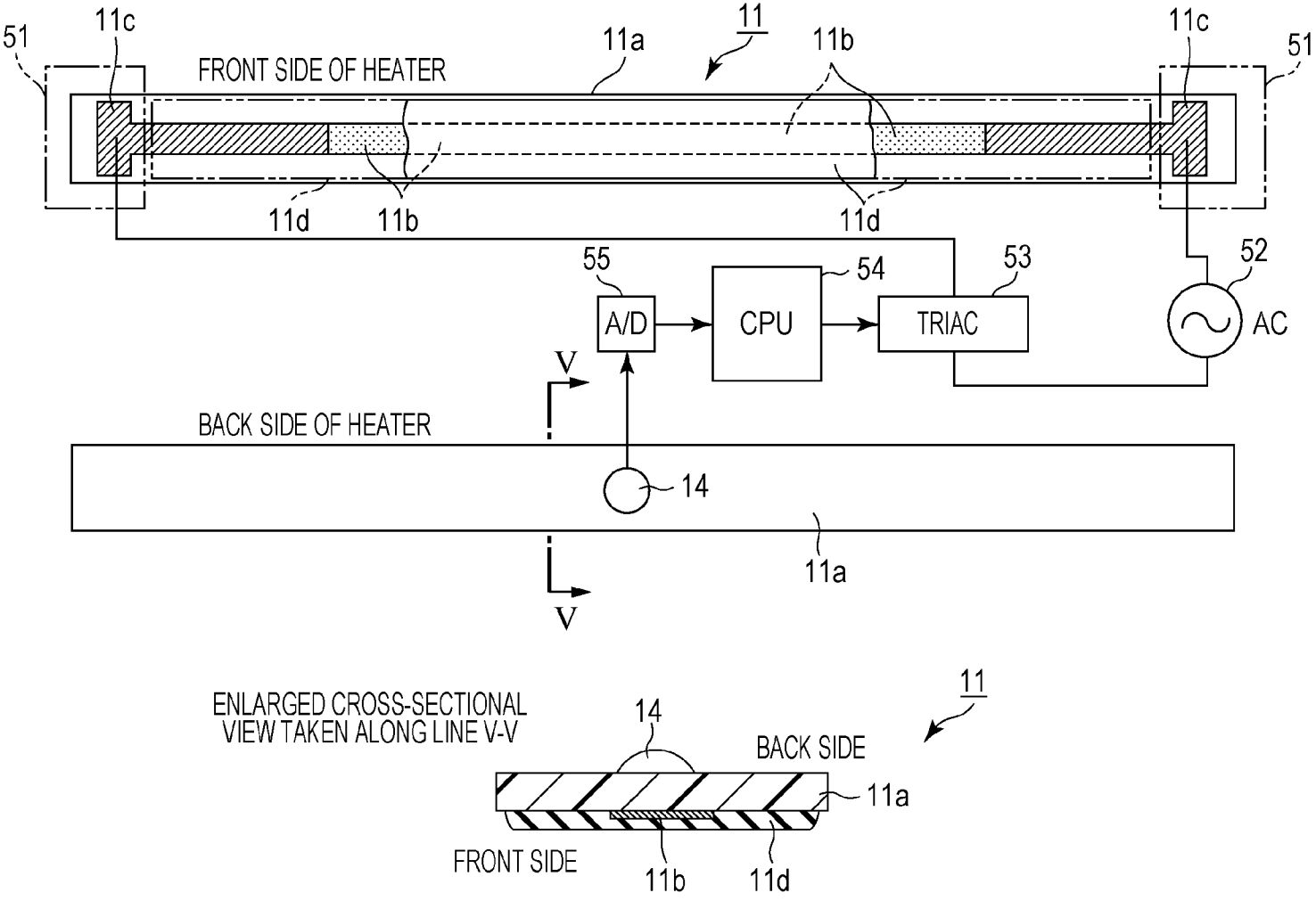
FIG. 5 is an explanatory view of an example configuration of a heater (ceramic heater).

FIG. 5 is an explanatory view of an example configuration of the heater 11.

The heater 11 is a member for heating the fixing belt 10 to melt and fix the image T on the sheet P at the nip portion N.

As illustrated in FIG. 5, the heater 11 includes components described below.

A ceramic substrate (heater substrate) 11*a* made of a highly insulating ceramic and having a horizontally long shape.

A resistive layer 11*b* formed along the longitudinal direction (width direction) on the front side of the ceramic substrate 11*a*.

Electrode portions 11*c* made of silver/platinum (Ag/Pt) and formed by providing conduction of electricity to the both ends of the resistive layer 11*b* in the longitudinal direction.

An insulating protective layer 11*d*, such as a glass coating or fluoroplastic coating, being thin, capable of enduring frictional sliding with the metal fixing belt 10, disposed on the front side of the resistive layer 11*b*, and electrically insulating.

A temperature sensing element 14, such as a thermistor, disposed on the back (rear surface) side of the ceramic substrate 11*a*.

A highly insulating ceramic, such as the one made of aluminum nitride (AlN), or a heat-resistant resin, such as polyimide, polyphenylene sulfide (PPS), or a liquid polymer, can be used in the ceramic substrate 11*a*. The resistive layer 11*b* is formed by applying a material, such as silver/palladium (Ag/Pd), uthenium oxide ($RuO_2$), or tantalum nitride ($Ta_2N$), on the substrate by, for example, screen printing. The resistive layer 11*b* has a linear or strip shape with a thickness of the order of approximately 10 μm and a width of the order of 1 to 5 mm.

In the above-described heater 11, the side on which the insulating protective layer 11*d* is disposed is the front side, and the fixing belt 10 slides on the surface of the insulating protective layer 11*d*. The heater 11 is fit in the recess 12*a* (see FIG. 3), which extends along the longitudinal direction of the stay holder 12 in the lower surface of the stay holder 12, bonded with a heat-resistant adhesive, and held therein.

Electric supply connectors 51 are attached to the electrode portions 11*c* in the heater 11 fixed and supported by the stay holder 12 and include electric contacts being in contact with the electrode portions 11*c*. A commercial power source (AC) 52, a triac 53, and an electric power (energization) controller (CPU) 54 are connected (AC line). The temperature of the heater 11 quickly is raised by heat of the resistive layer 11*b* generate by electric power supplied between the electrode portions 11*c* from the commercial power source 52 through the triac 53.

The rise of temperature in the heater 11 is sensed by the temperature sensing element 14 being a temperature sensing member. Electric analog information on the sensed temperature is input into an analog-to-digital converting circuit (A/D converting circuit) 55 and is digitized. The digital information is input into the electric power controller 54. DC energization is performed from the temperature sensing element 14 to a temperature control portion by a connector (not illustrated) through a DC energization portion and DC electrode portion (not illustrated).

In accordance with a signal from the temperature sensing element 14, a duty ratio of a voltage applied from the electrode portions 11*c* on the ends of the heater 11 in the longitudinal direction to the resistive layer 11*b*, the number of waves, and other factors are properly controlled. The adjusted temperature in the nip portion N is maintained substantially constant, and heating sufficient for fixing the image T on the sheet P is carried out. That is, the electric power controller 54, which receives digital information corresponding to the temperature sensed by the temperature sensing element 14, is configured to control energization from the commercial power source 52 to the resistive layer 11*b* such that the temperature sensed by the temperature sensing element 14 is a value in a range having a predetermined width from a target temperature.

Examples of a method of controlling energization from the commercial power source 52 to the resistive layer 11*b* by the electric power controller 54 are described below. One example is phase control of changing a phase range for the energization from the commercial power source 52 to the resistive layer 11*b* for each half-wave period of the AC power supply output from the commercial power source 52 in accordance with the temperature sensed by the temperature sensing element 14. Another example is wave number control of switching between energization from the commercial power source 52 to the resistive layer 11*b* and non-energization for each half-wave period of the AC power supply output from the commercial power source 52 in accordance with the temperature sensed by the temperature sensing element 14.

When a highly thermally conductive material having high wear resistance, such as aluminum nitride, is used in the ceramic substrate 11*a*, the resistive layer 11*b* may be disposed on the side of the ceramic substrate 11*a* opposite to the nip portion N.

The stay holder 12 performs the function of supporting the heater 11 and serves as a member for guiding rotation of the fixing belt 10, as a pressing member, and as a thermal insulating member to prevent heat dissipation in a direction opposite to the nip portion N. Accordingly, the stay holder 12 functions as both the pressing member and first and second guide portions. The stay holder 12 is a rigid, heat-resistant, adiabatic member made of, for example, a liquid polymer, phenol resin, PPS, or polyetheretherketone (PEEK).

In the present embodiment, a section downstream of the nip portion N in the stay holder 12 projects toward the pressure roller 20 as a projecting section K having a height of 1.0 mm (see FIG. 3; jaw section for changing the curvature of the fixing belt 10). The projecting section K is used for changing the rotational shape of the fixing belt 10 and separating the sheet P from the fixing belt 10 using the changed curvature.

Figure 6:
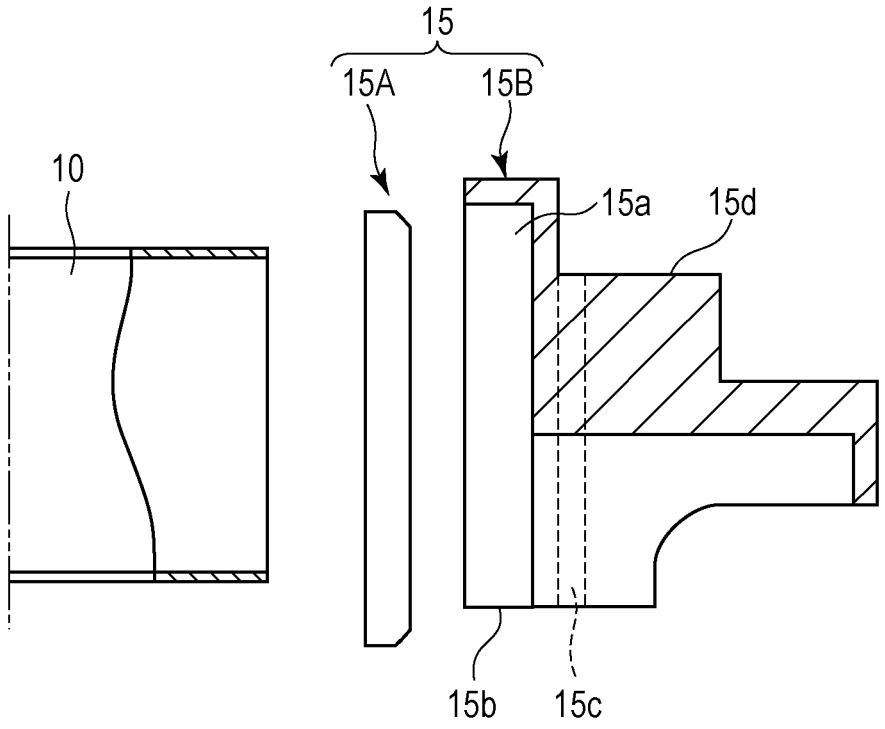
FIG. 6 is a cross-sectional explanatory view of a flange portion and a fixing belt.
Figure 7:
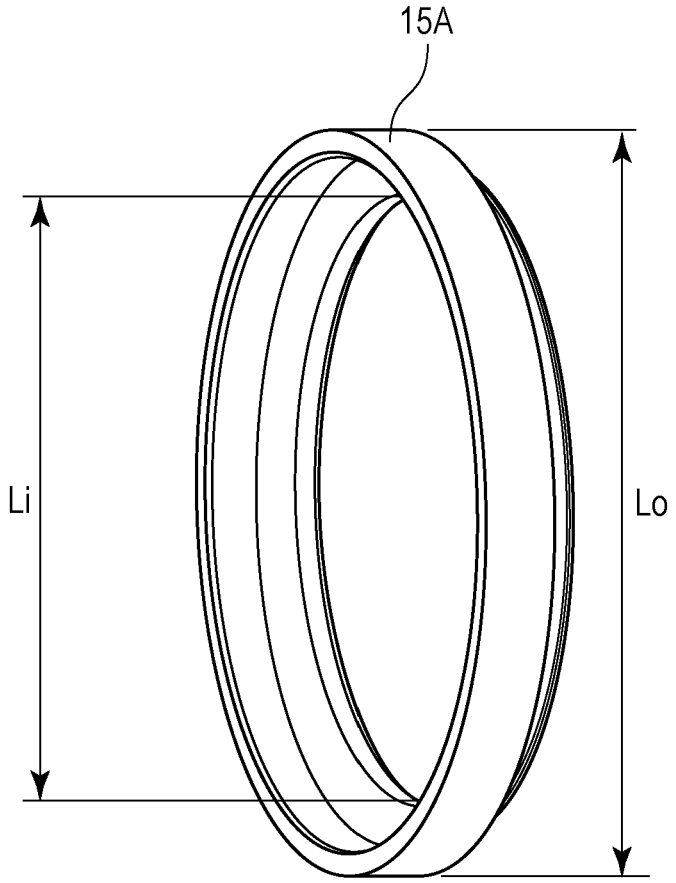
FIG. 7 is a perspective explanatory view of a rotational flange.

FIG. 6 is a cross-sectional explanatory view of the flange portion and the fixing belt. FIG. 7 is a perspective explanatory view of a rotational flange.

The flange portion 15 is arranged on each of both right and left ends (first and second ends) of the stay holder 12 functioning as the first and second guide portions. The flange portion 15 regulates lateral movement of the fixing belt 10 in the width direction on each of both ends of the pressure roller 20. As illustrated in FIG. 6, the flange portion 15 includes a rotational flange 15A and a fixed flange 15B. The rotational flange 15A is a member having a ring shape with no end or a disc shape. The rotational flange 15A performs driven rotation by abutting the end face of the rotating fixing belt 10. The fixed flange 15B is a member whose rotation is regulated by the side plate 31. The fixed flange 15B regulates movement of the rotational flange 15A in the width direction caused by the fixing belt 10.

The fixed flange 15B is made of a heat-resistant resin, such as PPS, a liquid polymer, or phenol resin. The fixed flange 15B has a cap shape and includes an insertion section 15*a* in its inner surface side. The insertion section 15*a* has an inside diameter allowing the rotational flange 15A as a first regulating member to be inserted therein. The inside diameter has a sufficiently large size in which even if the outer peripheral shape of the fixing belt 10 is deformed by forming the nip, the outer peripheral surface of the fixing belt 10 does not come into contact with the inner peripheral surface of the insertion section 15*a*. The fixed flange 15B as a member for regulating the rotational flange 15A regulates the rotational flange 15A in the width direction and regulates the position of rotation of the rotational flange 15A.

The rotational flange 15A is made of PPS, which is a heat-resistant resin. Another heat-resistant resins, such as a liquid polymer or phenol resin, may also be used. The rotational flange 15A has a ring cap shape, as illustrated in FIG. 7. The rotational flange 15A has an outside diameter Lo smaller than the inside diameter of the insertion section 15*a* in the fixed flange 15B and larger than a cut section 15*b*. The rotational flange 15A has an inside diameter Li having a size that does not interfere with the heater 11. An outward extended portion 12*b* in the stay holder 12 is positioned within the inside diameter Li. The rotational flange 15A is arranged so as not to interfere with the outward extended portion 12*b* in the stay holder 12. The rotational flange 15A prevents frictional sliding of the end face of the fixing belt 10 by rotating together with the fixing belt 10 while its inside is in contact with the fixing belt 10.

[Scraper]

In the fixing apparatus 6 according to the present embodiment, a component of the lubricant transferred to the pressure roller 20 from the inside of the heating unit 9 is scraped by the scrapers 60 (lubricant scraping member). The scrapers 60 discourage adhesion of the lubricant to the sheet P introduced into the fixing apparatus 6.

First, a lubricant moving-around phenomenon is described. In the above-described fixing apparatus 6, a lubricant, such as a heat-resistant grease, is applied on the surface of each of the heater 11 and the stay holder 12, thus reducing the friction between the fixing belt 10 and each of the heater 11 and the stay holder 12. The heater 11 and the stay holder 12 are urged toward the pressure roller 20 such that the fixing belt 10 is nipped.

Accordingly, the heat-resistant grease as the lubricant receives pressure between the fixing belt 10 and each of the heater 11 and the stay holder 12. In this state, when the fixing belt 10 is rotated by rotation of the pressure roller 20, the grease is pressed and extended toward the ends of the heating unit 9 in the width direction. The grease spread toward the ends may leak out from the ends of the fixing belt 10.

The leaked grease moves around and adheres to the surface of the fixing belt 10 by its viscosity or pressing-back from the rotational flange 15A. The grease adhering to the surface of the fixing belt 10 is moved to the locations of the ends of the nip portion N constituted by the fixing belt 10 and the pressure roller 20 by, for example, being pressed by subsequently leaking grease. When the grease moved to the locations of the ends of the nip portion N in the width direction is nipped, pressed, and extended by the nip portion N, the grease may be transferred to a sheet passage area A1 in the pressure roller 20 (area that can come into contact with the sheet P with a maximum width introducible into the apparatus), as illustrated in FIG. 2.

If the grease having reached the area A1 in the above-described way adheres to the sheet P at the time of image formation, this may lead to an image defect. To avoid such a defect, the grease can be removed before it reaches the area A1.

As illustrated in FIG. 2, the pressure roller 20 has an area A2 through which the sheet P does not pass (area that does not come into contact with the sheet P with the maximum width introducible into the apparatus) on each of the ends in its rotational axis direction. While the grease lies in the area A2, that grease does not stain the sheet P. Thus the scrapers 60 disposed in the area A2 can scrape the grease before it reaches the area A1. Each of the scrapers 60 is arranged so as not to come into contact with the area A1, through which the sheet P passes, (area that can come into contact with the sheet P with the maximum width introducible into the apparatus) in the pressure roller 20 and thus has a configuration that does not substantially affect the fixing process. The scraper 60 is described in detail below with reference to the drawings.

The scraper 60 is a member for scraping a lubricant, such as grease, adhering to the surface of the pressure roller 20. The fixing apparatus 6 according to the present embodiment has a configuration including two scrapers 60. One of the scrapers 60 is in contact with the surface of the pressure roller 20 in the area A2 on one end side of the pressure roller 20 in the longitudinal direction. The other of the scrapers 60 is in contact with the surface of the pressure roller 20 in the area A2 on another end side of the pressure roller 20 in the longitudinal direction. If the scraper 60 comes into contact with the surface of the pressure roller 20 in the area A1, the surface of the pressure roller 20 may become rough or the like, and this may affect the fixing process. If the scraper 60 derives heat of the pressure roller 20 in the area A1, temperature unevenness may occur in the pressure roller 20, and this may affect the fixing process. To address these issues, the scraper 60 can be arranged so as not to be in contact with the area A1.

The scraper 60 according to the present embodiment is spaced from the end of the area A1 in the width direction by a small distance in the area A2. The small distance can be on the order of 2 mm in consideration of individual differences among sheets P and positioning errors at the time of conveyance. If the effects of the individual differences among sheets P and the positioning errors at the time of conveyance on the fixing process are in an allowable range, the scraper 60 may be in contact with the whole of the area A2.

The scraper 60 according to the present embodiment is a rubber blade having a width of approximately 5 mm. As illustrated in FIG. 3, one end of the scraper 60 is bonded and fixed on the apparatus housing 30. Hereinafter, this end is referred to as fixed edge. The other end of the scraper 60 is in contact with the surface of the pressure roller 20. Hereinafter, this end is referred to as contact edge. Instead of the rubber blade, a biaxially-oriented polyethylene terephthalate (BoPET) member may also be used as the scraper 60. The width of the scraper 60 is not limited to approximately 5 mm and may be larger or smaller than 5 mm if it has a size sufficient for removing the grease.

The contact edge is positioned upstream of the fixed end in the rotational direction of the pressure roller 20 (with reference to the nip portion N). That is, the scraper 60 is in elastic contact with the pressure roller 20 in a direction counter to the rotational direction of the pressure roller 20. When the contact edge is in contact with the pressure roller 20 along its surface, the scraper 60 scrapes the grease transported together with rotation of the pressure roller 20. The scraped grease is accumulated in the bottom section of the apparatus housing 30 in the fixing apparatus 6. A container or the like for collecting the grease may be disposed in the bottom section of the apparatus housing 30.

When the fixing apparatus 6 is in use, the above-described scraper 60 functions as follows. That is, when the fixing belt 10 is rotated by driving of the pressure roller 20 resulting from the execution of the fixing process, the grease gradually leaks from the ends of the fixing belt 10 in the longitudinal direction. The leaked grease moves along the surface of the fixing belt 10 in the width direction of the fixing belt 10 and reaches the nip portion N. The space between each of the ends of the fixing belt 10 and the nip portion N is on the order of 3 mm. This space may be reduced. For example, the end location of the fixing belt 10 and the end location of the pressure roller 20 may coincide with each other.

The grease is pressed by the nip portion N and transferred from the surface of the fixing belt 10 to the surface of the pressure roller 20. Not all of the grease adhering to the surface of the fixing belt 10 is transferred to the surface of the pressure roller 20 at a time. The rotation of the fixing belt 10 repeatedly causes the surface of the pressure roller 20 and the surface of the fixing belt 10 to come into contact with each other, and this gradually transfers the grease to the pressure roller. In particular, when a heating member, such as the heater 11, is near the fixing belt 10, as in the present embodiment, the temperature around the fixing belt 10 tends to be higher than the temperature around the pressure roller 20. Thus when a grease in which its viscosity reduces with an increase in temperature is used, as in the present embodiment, because the viscosity of the grease on the fixing belt 10 is relatively low, the grease tends to be transferred to the pressure roller 20. Before the grease transferred to the pressure roller 20 reaches the area A1, it is transported to the scraper 60 by the rotation of the pressure roller 20 and is scraped by the scraper 60.

In this way, the grease transferred to the pressure roller 20 is promptly scraped by the scraper 60. That is, because the grease is scraped in the area A2, it does not move to the passage area A1. Accordingly, contamination of the sheet P or an image caused by the grease adhering to the sheet P can be suppressed.

In the foregoing description, the direction in which the scraper 60 scrapes the grease is described as the radial direction of the pressure roller 20. The direction in which the grease is scraped is not limited to that direction. For example, the scraper 60 may scrape the grease by pushing it outward from the end in the rotational axis direction of the pressure roller 20.

Specifically, the scraper 60 is arranged such that, at the contact edge, its end near the central section in the longitudinal direction of the pressure roller 20 is in contact with the pressure roller 20 on the upstream side in the rotational direction of the pressure roller 20. The scraper 60 is arranged such that its end near the end section in the longitudinal direction of the pressure roller 20 is in contact with the pressure roller 20 on the downstream side in the rotational direction of the pressure roller 20. That is, the scraper 60 is in contact with the pressure roller 20 such that the longitudinal direction of the contact edge intersects with the rotational direction of the pressure roller 20. When the grease transported together with the rotation of the pressure roller 20 comes into contact with the contact edge, movement of the grease is guided from the central section toward the end section of the pressure roller 20.

The above-described relationship applies to both of the two scrapers 60. Thus a virtual straight line extended from the contact edge in the longitudinal direction of one of the scrapers 60 and that of the other of the scrapers 60 intersect with each other on the upstream side in the rotational direction of the pressure roller.

To scrape the grease in the above-described scraping direction, one end of the contact edge of one of the scrapers 60 can project from one end of the pressure roller 20 in the rotational axis direction. One end of the contact edge of the other of the scrapers 60 can project from another end of the pressure roller 20 in the rotational axis direction. With this configuration, the grease can be ejected such that once the grease have been scraped by the scraper 60, it will not adhere to the pressure roller 20 again.

As described above, according to the present embodiment, the scraper 60 is arranged on the pressure roller 20 in an area that can come into contact with the fixing belt 10 and that does not come into contact with the sheet P with the maximum width introducible into the apparatus. Thus transferring of the grease to the pressure roller 20 in the area that can come into contact with the sheet P can be suppressed.

Accordingly, contamination of the sheet P or an image by a lubricant, such as a grease, can be suppressed.

Because the scraper 60 is not in contact with the fixing belt 10, frictional resistance to the fixing belt 10 can be reduced. Accordingly, stability of rotation of the fixing belt 10 can be maintained.

Because the scraper 60 is not in contact with the fixing belt 10, abrasion of the fixing belt 10 caused by frictional sliding can be reduced. Accordingly, a reduction in the life of the fixing belt 10 and an extension in the degree when the fixing belt 10 is damaged can be suppressed.

Second Embodiment

Figure 8:
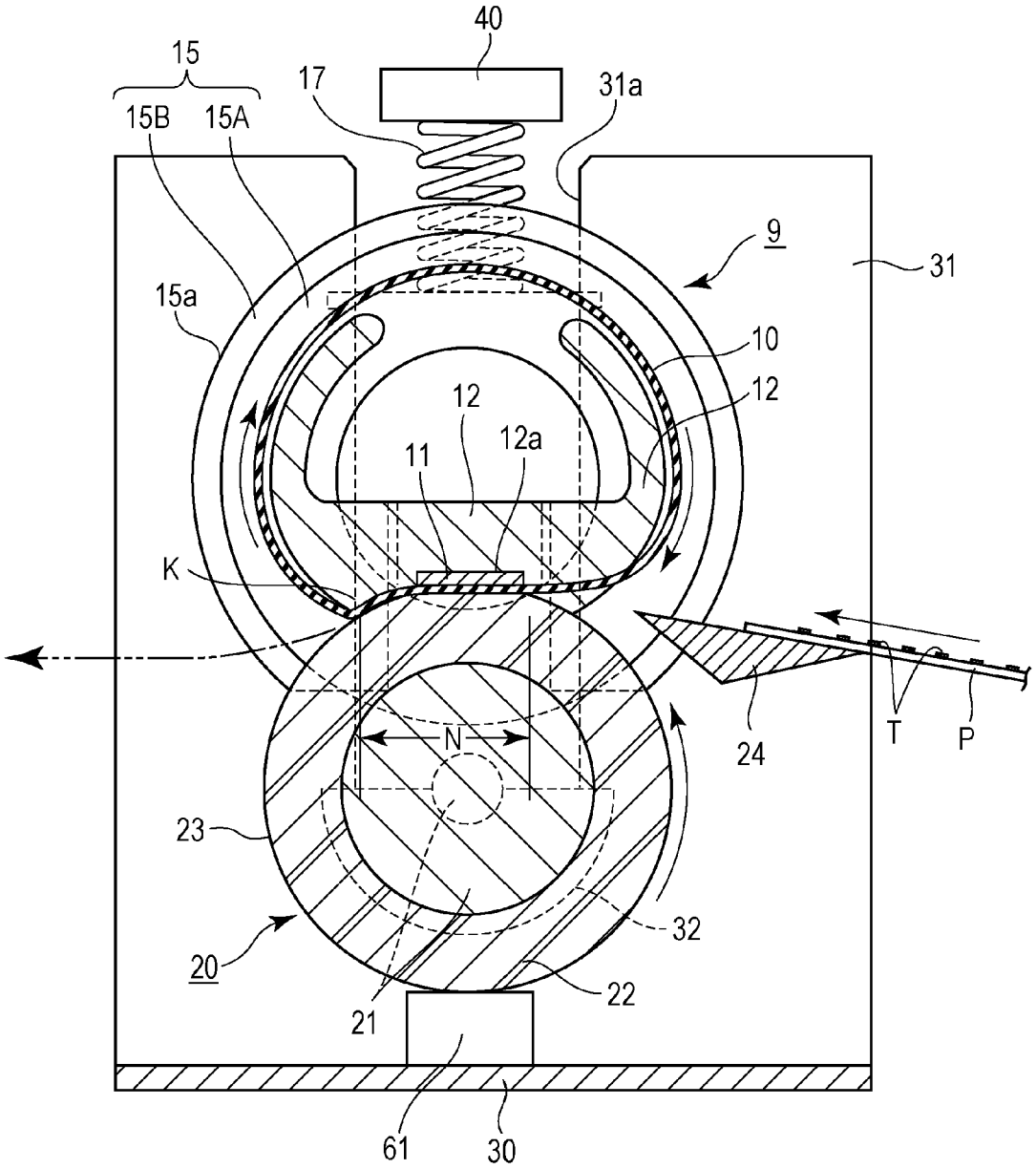
FIG. 8 is a cross-sectional explanatory view of a fixing apparatus according to a second embodiment taken along the line VIII-VIII in FIG. 2.

In the first embodiment, an example in which the scraper 60 are used as the scraping member is described. In a second embodiment, an example in which felts 61 are used as the scraping member is described. The configuration of the fixing apparatus 6 according to the present embodiment is substantially the same as that in the first embodiment, except for the use of the felts 61. Accordingly, the same reference numerals are used in the same configuration as in the first embodiment, and the description thereof is not repeated here. FIG. 8 is a cross-sectional explanatory view of a fixing apparatus according to the present embodiment taken along the line VIII-VIII in FIG. 2.

In the present embodiment, as illustrated in FIG. 8, the felts 61 (lubricant absorbers) as the scraping member are in contact with the surface of the pressure roller 20 in the area A2 on both ends in the rotational axis direction.

Each of the felts 61 is the scraping member using unwoven fabric or the like for absorbing a lubricant, such as a grease, adhering to the surface of the pressure roller 20. The fixing apparatus 6 according to the present embodiment has a configuration including two felts 61. One of the felts 61 is in contact with the surface of the pressure roller 20 in the area A2 on one end side of the pressure roller 20 in the longitudinal direction. The other of the felts 61 is in contact with the surface of the pressure roller 20 in the area A2 on another end side of the pressure roller 20 in the longitudinal direction.

The felt 61 has one surface bonded to the bottom section of the apparatus housing 30 and another surface being in contact with the surface of the pressure roller 20. The felt 61 can be a highly flame-retardant one capable of enduring contact with the high-temperature pressure roller 20. In the present embodiment, aramid felt GX 0778 (trade name) of AMBIC Co., Ltd. is used as the felt 61.

To sufficiently remove the grease, in the present embodiment, the felt 61 having the dimensions of 5×8×3 (mm) is disposed such that it is in contact with the pressure roller 20 in each of the conveyance direction and the width direction by 5 mm and such that a portion of the remaining 3 mm in the width direction protrudes from the end of the pressure roller 20. In the area where the felt 61 is in contact with the pressure roller 20, the felt 61 is pressed in contact with the pressure roller 20 such that its thickness is reduced from 3 mm to 2 mm.

When the fixing apparatus 6 is in use, the above-described felt 61 functions as follows. That is, when the fixing belt 10 is rotated by driving of the pressure roller 20 resulting from the execution of the fixing process, the grease gradually leaks from the ends of the fixing belt 10 in the longitudinal direction. The leaked grease moves along the surface of the fixing belt 10 in the width direction of the fixing belt 10 and reaches the nip portion N. The grease is pressed by the nip portion N and transferred from the surface of the fixing belt 10 to the surface of the pressure roller 20. Before the grease transferred to the pressure roller 20 reaches the area A1, the grease is transported to the felt 61 by the rotation of the pressure roller 20, and it is scraped by the felt 61 and absorbed in the gaps in the fabric.

In this way, the grease transferred to the pressure roller 20 is promptly scraped by the felt 61. That is, because the grease is scraped in the area A2, it does not move to the area A1. Accordingly, contamination of the sheet P or an image caused by the grease adhering to the sheet P can be suppressed.

The felt 61 can have an area projecting from the end of the pressure roller 20 at a site that can come into contact with the fixing belt 10 in the rotational axis direction of the pressure roller 20. The felt 61 can have at least an area being in contact with the edge section of the pressure roller 20 at a site that can come into contact with the fixing belt 10.

In particular, when a grease having a high viscosity is used, a part of the grease adhering to the surface of the fixing belt 10 may be transferred in a block to the corner section (edge section) of the end of the pressure roller 20. When the block of the grease transferred to the edge section is rotated together with the pressure roller 20, it gradually enters the nip portion N. With the above-described configuration, the grease transferred from the fixing belt 10 to the edge section of the pressure roller 20 and having not yet reached the nip portion N can be scraped and dropped in the block state.

Thus the amount of the grease having reached the nip portion N can be reduced, and the amount of the grease absorbed by the felt 61 can be suppressed. This may lead to an extended period of use of the felt 61.

As described above, according to the present embodiment, the felt 61 is arranged on the pressure roller 20 in the area that can come in contact with the fixing belt 10 and that does not come into contact with the sheet P with the maximum width introducible into the fixing apparatus 6. Thus transferring of the grease to the area that can come into contact with the sheet P in the pressure roller 20 can be suppressed.

Accordingly, contamination of the sheet P or an image caused by a lubricant, such as a grease, can be suppressed. Because the felt 61 is not in contact with the fixing belt 10, the frictional resistance to the fixing belt 10 can be reduced. Accordingly, stability of rotation of the fixing belt 10 can be maintained.

Because the felt 61 is not in contact with the fixing belt 10, abrasion of the fixing belt 10 caused by frictional sliding can be reduced. Accordingly, a reduction in the life of the fixing belt 10 and an extension in the degree when the fixing belt 10 is damaged can be suppressed.

Other Embodiments

The first and second embodiments are described above. The configurations for implementing the present invention are not limited to the configurations described in the above embodiments.

The fixing apparatus according to the first embodiment has a configuration including the fixing belt and the pressure roller. Another example configuration may be the one in which instead of the pressure roller, a pressure belt (endless belt) is used, and the lubricant scraping member is in contact with each of both ends of the pressure belt in the width direction. This configuration can also achieve substantially the same advantages.

The heating member and the pressing member in the fixing apparatus according to the first embodiment are a ceramic heater held by the stay holder on the inner surface of the fixing belt. As a unit configured to heat the nip portion, a fixing belt that generates heat by electromagnetic induction using, for example, an excitation coil may be used. In that case, as the pressing member for pressing the fixing belt against the pressure roller, a nip pad or the like may be used.

The image heating apparatus described as the fixing apparatus in each of the first and second embodiments is also applicable as a surface heating apparatus that adjusts gloss or surface formation of an image. The image heating apparatus can be implemented as a single apparatus singularly settable or operable or a component unit, other than as being embedded in an image forming apparatus. The image forming apparatus using the image heating apparatus is not limited to an image forming apparatus for forming monochrome images and may be an image forming apparatus for forming full-color images. When other devices, equipment, or housing structures are added to the image heating apparatus depending on the use, the image heating apparatus can be used in various image forming apparatuses, such as printers, copiers, and facsimile machines.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-166255, filed Aug. 9, 2013, which is hereby incorporated by reference herein in its entirety.

What is claimed is:

1. An image heating apparatus comprising:

an endless belt configured to heat an image on a sheet, said endless belt having an inner surface on which a lubricant is applied;

a rotating member configured to form a nip portion between said rotating member and said endless belt;

a pressing member configured to contact with said inner surface of said endless belt and press said rotating member through said endless belt; and a scraping member configured to contact with said rotating member at such a position that is outside from an end of an area of said rotating member which comes into contact with a maximum width sheet introducible into the image heating apparatus in the rotational axis direction of said rotating member, and to scrape off the lubricant transferred from said endless belt to said rotating member.

2. The image heating apparatus according to claim 1, wherein said scraping members comprises unwoven fabric.

3. The image heating apparatus according to claim 1, wherein said pressing member includes a heating member configured to heat said endless belt.

4. The image heating apparatus according to claim 1, wherein said rotating member is a roller.

5. The image heating apparatus according to claim 1, wherein the lubricant is grease.

6. The image heating apparatus according to claim 1, wherein said scraping member contacts with an edge portion of said rotating member in one end in a rotational axis direction of said rotating member.

7. An image heating apparatus comprising:

an endless belt configured to heat an image on a sheet, said endless belt having an inner surface on which a lubricant is applied;

a rotating member configured to form a nip portion between said rotating member and said endless belt;

a pressing member configured to contact with said inner surface of said endless belt and press said rotating member through said endless belt; and a scraping member provided on one end side of a rotational axis direction of said rotating member and configured to scrape off the lubricant transferred from said endless belt to said rotating member, wherein said scraping member comes into contact with an edge portion of said rotating member in one end in the rotational axis direction of said rotating member.

8. The image heating apparatus according to claim 7, further comprising:

another scraping member provided on one end side of a rotational axis direction of said rotating member and configured to scrape off the lubricant transferred from said endless belt to the rotating member, wherein said another scraping member comes into contact with such a position that is an area of said rotating member provided at predetermined interval from and provided outside said an end of an area of said rotating member where comes into contact with a maximum width sheet introducible into the image heating apparatus in the rotational axis direction of said rotating member.

9. The image heating apparatus according to claim 8, wherein said scraping members comprises unwoven fabric.

10. The image heating apparatus according to claim 7, wherein said pressing member includes a heating member configured to heat said endless belt.

11. The image heating apparatus according to claim 7, wherein said rotating member is a roller.

12. The image heating apparatus according to claim 7, wherein the lubricant is grease.

13. The image heating apparatus according to claim 7, wherein said scraping member projects outward in said longitudinal direction than one end of said rotating member.

* * * * *